US009758912B2

(12) United States Patent
Abbott et al.

(10) Patent No.: US 9,758,912 B2
(45) Date of Patent: Sep. 12, 2017

(54) RINSING STATION FOR SPRAY DYEING SYSTEM

(71) Applicant: HBI Branded Apparel Enterprises, LLC, Winston-Salem, NC (US)

(72) Inventors: Michael D. Abbott, Statesville, NC (US); Robert A. Miller, III, New Ringgold, PA (US); Ruth E. May, Schuylkill Haven, PA (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 237 days.

(21) Appl. No.: 14/296,033

(22) Filed: Jun. 4, 2014

(65) Prior Publication Data

US 2014/0283313 A1 Sep. 25, 2014

Related U.S. Application Data

(63) Continuation of application No. 12/371,812, filed on Feb. 16, 2009, now Pat. No. 8,814,953, which is a (Continued)

(51) Int. Cl.

| | |
|---|---|
| ***D06B 23/20*** | (2006.01) |
| ***D06B 1/02*** | (2006.01) |
| ***D06B 15/02*** | (2006.01) |
| ***D06B 23/02*** | (2006.01) |
| ***D06B 23/00*** | (2006.01) |

(Continued)

(52) U.S. Cl.

CPC ..... *D06B 23/20* (2013.01); *D06B 1/02* (2013.01); *D06B 15/025* (2013.01); *D06B 19/0029* (2013.01); *D06B 21/00* (2013.01); *D06B 23/00* (2013.01); *D06B 23/02* (2013.01); *D06C 3/06* (2013.01); *D06P 1/0016* (2013.01); *D06P 7/00* (2013.01); *D06B 5/00* (2013.01); *Y10S 8/916* (2013.01); *Y10S 8/92* (2013.01)

(58) Field of Classification Search

None

See application file for complete search history.

(56) References Cited

U.S. PATENT DOCUMENTS

| | | | | |
|---|---|---|---|---|
| 1,893,197 | A | 1/1933 | Cohn | |
| 2,406,108 | A * | 8/1946 | Schellenberg | D06F 45/18 68/158 |

(Continued)

FOREIGN PATENT DOCUMENTS

| | | |
|---|---|---|
| CN | 1671800 | 9/2005 |
| DE | 19633101 | 2/1998 |

(Continued)

OTHER PUBLICATIONS

Chinese Office Action dated Sep. 25, 2014 in CN 200780008843.4.

*Primary Examiner* — Katie L Hammer

(74) *Attorney, Agent, or Firm* — Fish & Richardson P.C.

(57) ABSTRACT

A rinsing station for removing residual materials from a fabric being dyed or bleached. The rinsing station includes a first pair of rinse spray nozzles. One of the first pair directed to spray a rinse fluid downwardly onto incoming dyed fabric. The other of the first pair directed to spray the rinse fluid upwardly onto the incoming dyed fabric. The rinsing station also includes a pair of nip rollers downstream for the first pair of rinse spray nozzles for extracting the rinse fluid.

20 Claims, 4 Drawing Sheets

Related U.S. Application Data continuation-in-part of application No. 11/395,848, filed on Mar. 31, 2006, now Pat. No. 7,799,097, which is a continuation-in-part of application No. 10/601,820, filed on Jun. 23, 2003, now Pat. No. 7,033,403.

(51) Int. Cl.

| | |
|---|---|
| ***D06P 7/00*** | (2006.01) |
| ***D06B 19/00*** | (2006.01) |
| ***D06B 21/00*** | (2006.01) |
| ***D06P 1/00*** | (2006.01) |
| ***D06C 3/06*** | (2006.01) |
| *D06B 5/00* | (2006.01) |

(56) References Cited

U.S. PATENT DOCUMENTS

| | | | | |
|---|---|---|---|---|
| 2,532,471 | A * | 12/1950 | Wedler | D06B 1/02 68/1 |
| 2,915,230 | A | 12/1959 | Brewin et al. | |
| 2,974,838 | A | 3/1961 | Parham | |
| 2,985,502 | A | 5/1961 | Kronsbein et al. | |
| 2,990,087 | A | 6/1961 | Brewin et al. | |
| 2,990,088 | A | 6/1961 | Isken et al. | |
| 3,022,926 | A | 2/1962 | Bailey, Jr. | |
| 3,181,749 | A | 5/1965 | Storr et al. | |
| 3,827,262 | A * | 8/1974 | Manuel | D06F 31/00 118/316 |
| 3,978,557 | A | 9/1976 | Goodson | |
| 4,070,878 | A * | 1/1978 | Valls | D06B 5/08 68/205 R |
| 4,087,993 | A * | 5/1978 | Sando | D06B 3/201 26/18.5 |
| 4,277,860 | A * | 7/1981 | Sando | D06B 3/201 8/151 |
| 4,466,149 | A * | 8/1984 | Schuierer | D06B 3/26 68/20 |
| 4,612,016 | A | 9/1986 | Jaeger et al. | |
| 4,659,333 | A | 4/1987 | Schaub | |
| 4,717,391 | A | 1/1988 | Daniel et al. | |
| 4,786,721 | A | 11/1988 | Tzikas et al. | |
| 4,792,619 | A | 12/1988 | Berendt et al. | |
| 5,010,612 | A | 4/1991 | Jensen | |
| 5,016,308 | A | 5/1991 | McBride et al. | |
| 5,205,305 | A | 4/1993 | Yamakita | |
| 5,288,322 | A | 2/1994 | Hanna et al. | |
| 5,458,265 | A | 10/1995 | Hester et al. | |
| 5,593,072 | A | 1/1997 | Hester et al. | |
| 5,713,223 | A | 2/1998 | Lin | |
| 5,775,136 | A * | 7/1998 | Chao-Cheng | D06B 1/02 68/15 |
| 5,951,717 | A | 9/1999 | Mrotzeck et al. | |
| 5,964,407 | A | 10/1999 | Sandkleiva | |
| 6,063,137 | A | 5/2000 | Scheibli et al. | |
| 6,120,560 | A | 9/2000 | Miller et al. | |
| 6,381,996 | B1 * | 5/2002 | Chang | D06B 3/24 68/178 |
| 6,393,871 | B1 | 5/2002 | Chiang | |
| 6,443,569 | B1 | 9/2002 | Mheidle et al. | |
| 6,471,729 | B1 | 10/2002 | Voth et al. | |
| 7,144,431 | B2 | 12/2006 | Gardner et al. | |
| 2002/0138922 | A1 | 10/2002 | Schmiedle et al. | |
| 2003/0104969 | A1 * | 6/2003 | Caswell | A47F 1/08 510/513 |
| 2004/0154146 | A1 | 8/2004 | Pruitt, Jr. | |
| 2004/0261194 | A1 * | 12/2004 | Price | C11D 3/0015 8/137 |
| 2006/0265813 | A1 * | 11/2006 | Miller | D06B 19/0029 8/115.51 |

FOREIGN PATENT DOCUMENTS

| | | |
|---|---|---|
| EP | 1233098 | 8/2002 |
| EP | 1275700 | 1/2003 |
| IT | PD2001A000089 | 4/2001 |
| WO | WO9628604 | 9/1996 |
| WO | WO 2004/013235 A1 | 2/2004 |

* cited by examiner

RINSING STATION FOR SPRAY DYEING SYSTEM

RELATED APPLICATIONS

This application is a continuation of U.S. patent application Ser. No. 12/371,812, filed Feb. 16, 2009, which is a continuation-in-part of U.S. patent application Ser. No. 11/395,848, filed Mar. 31, 2006, now U.S. Pat. No. 7,799,097, which is a continuation-in-part of U.S. patent application Ser. No. 10/601,820, filed Jun. 23, 2003, now U.S. Pat. No. 7,033,403, the contents of all of which are incorporated by reference herein.

FIELD OF THE INVENTION

The present invention is related to fabric coloring. More particularly, the present invention is related to a system and method for spray dyeing and/or bleaching fabrics.

BACKGROUND OF THE INVENTION

Today, fabrics are made from a wide variety of natural fibers, such as cotton, synthetic fibers, and combinations thereof. The basic fabric is a greige fabric that must be dyed and/or bleached in order to provide the desired color to the resultant fabric and/or garment. Many dye compositions and methods have been proposed for dyeing fabrics; however, dyeing greige fabric remains costly in terms of materials, labor, and/or processing time.

One conventional dyeing method, known as yarn dyeing, involves dyeing individual fibers or yarns prior to the fibers or yarns being sewn, knitted, or woven into a fabric. A significant problem associated with this method is the substantial inventory requirement to maintain a supply of the various colored yarns needed to produce various products, and the prohibitively high inventory costs resulting therefrom.

Another conventional dyeing method is known as bulk dyeing. In bulk dyeing, un-dyed fibers or yarns are knitted or woven into a raw or undyed fabric. The raw fabric is subsequently scoured or bleached, and then dyed.

Common bulk dyeing methods include vat dyeing, beam dyeing, jet dyeing, and bath dyeing. Vat dyeing typically consists of immersing a piece of fabric in a vat of liquid dye. Beam dyeing involves winding a length of fabric about a perforated beam. The beam is then placed in a vessel where dye is pumped into the center of the beam, out of the perforations, and through the fabric. Jet dyeing involves placing the fabric in a high-pressure, high-temperature kettle of liquid dye. Bath dyeing involves immersing the fabric in a bath of dye in a rotating drum.

There are a number of problems, however, associated with bulk dyeing methods. First, the bulk dyeing process necessitates large volumes of water, which increases the costs of the bulk dyed fabrics, and has an adverse impact on the environment and conservation of natural resources. Also, some of the dyed fabric must be cut away from templates during the manufacture of a garment from the fabric. Since the bulk fabric has already been dyed, this results in increased costs due to the wasted dye and fabric.

A more significant problem with bulk dyed fabrics in the manufacture of garments is the unpredictability of consumer color preferences. In the garment industry, changes in consumers' preferences for one color over another color can lead to an overstock of the undesired colored garments and a back-order of the desired colored garments.

Other methods of dyeing fabrics involve printing dyes onto a surface of a fabric. These methods are commonly used to apply a decorative pattern on the surface of the fabric. Such printing methods include screen-printing and inkjet printing. While these methods have proven useful in quickly changing from one decorative pattern to another, they have not proven useful for large scale production of fabrics or garments.

Accordingly, there is a continuing need for flexible, low cost, low waste processes for dyeing fabrics.

DETAILED DESCRIPTION OF THE INVENTION

Figure 1:
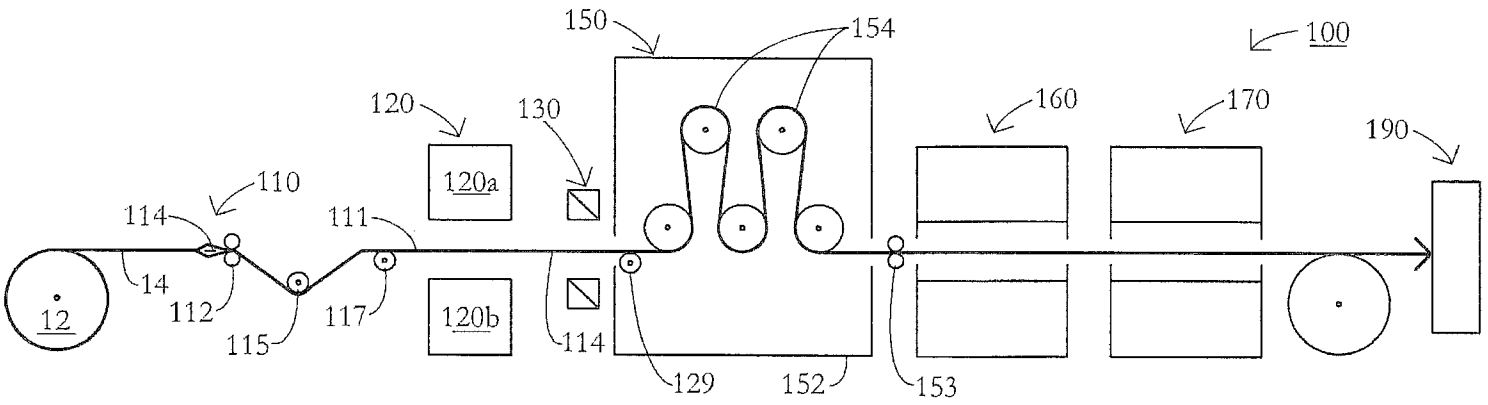
FIG. 1 is a schematic view of an exemplary embodiment of the system for dyeing and/or bleaching fabric according to the present invention.

Referring to the figures in general, and to FIG. 1, in particular, one aspect of the present invention is directed to a system, shown generally as reference numeral 100, for continuously dyeing a fabric. Another aspect of the present invention, as described herein, is the method for continuously dyeing a fabric with reference to the system.

In one exemplary embodiment, the system 100 comprises a fabric positioning station 110, a spray station 120, a fixation station 150, and at least one rinse station 160. As described in greater detail below, the system 100 may further comprise a drying unit 180 or a fabric handling station 190 (shown in FIG. 4). Shown generally as reference numeral 14, the fabric 14 may be a tubular knit fabric in its un-dyed or raw (greige) state, although the invention is not limited to dyeing tubular knit fabric. Indeed, any fabric substrate can be dyed using the system and method of the present invention.

Figure 2:
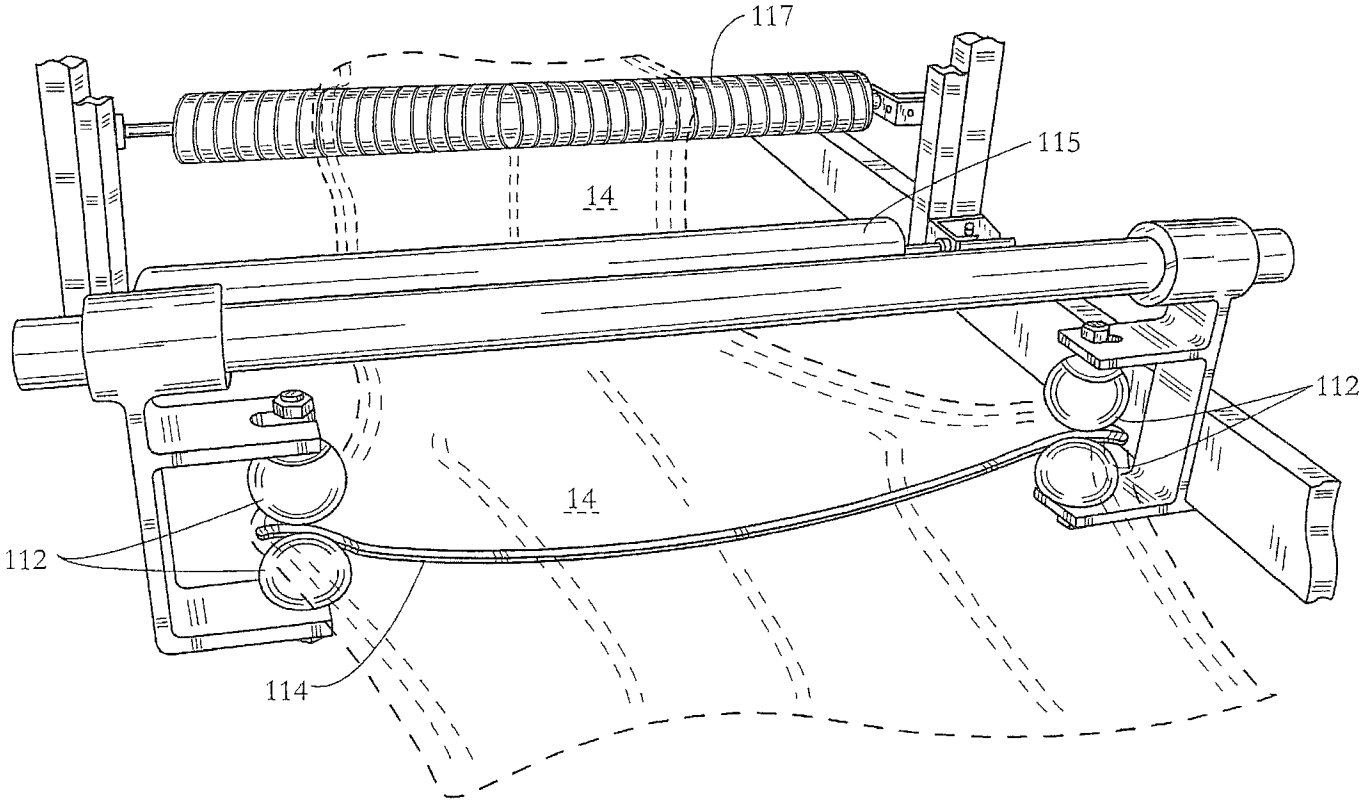
FIG. 2 is a perspective view of the ring guides and the scroll roll of the exemplary embodiment of the system of FIG. 1.

In one exemplary embodiment, fabric 14 is drawn from a supply of fabric, such as a knitting machine or fabric roll 12 by a downstream roller 117, as described in greater detail below. As shown in FIG. 1, at the fabric positioning station 110, folds are removed from the fabric 14. For example, the fabric 14 may be drawn through opposed ring guides 112, on either side of the flat fabric 14, over a spreader bar 114, or former, that opens the tubular fabric 14. As shown in FIG. 2, the ring guides each comprise a pair of balls, which rotate about a vertical axis to engage and hold the fabric 14 taut. The spreader 114 ensures that the fabric is flat and, thus, any folds or creases in the fabric are substantially removed.

After passing over the spreader 114 and through the ring guides 112, the fabric is allowed to relax as it passes beneath roller 115, which serves to maintain the appropriate tension on the fabric and guide the fabric to a driven scroll roll 117. As best shown in FIG. 2, the scroll roll 117 is a roller having a rubber outer coating with angled, raised ribs 117*a*, which diverge outwardly from the center of the roller toward the opposed ends 117*b* of the scroll roll 117. As the scroll roll 117 rotates, drawing the fabric 14 across the top of the roller 117, the ribs pull the fabric outwardly to keep it taught and smooth.

Figure 3:
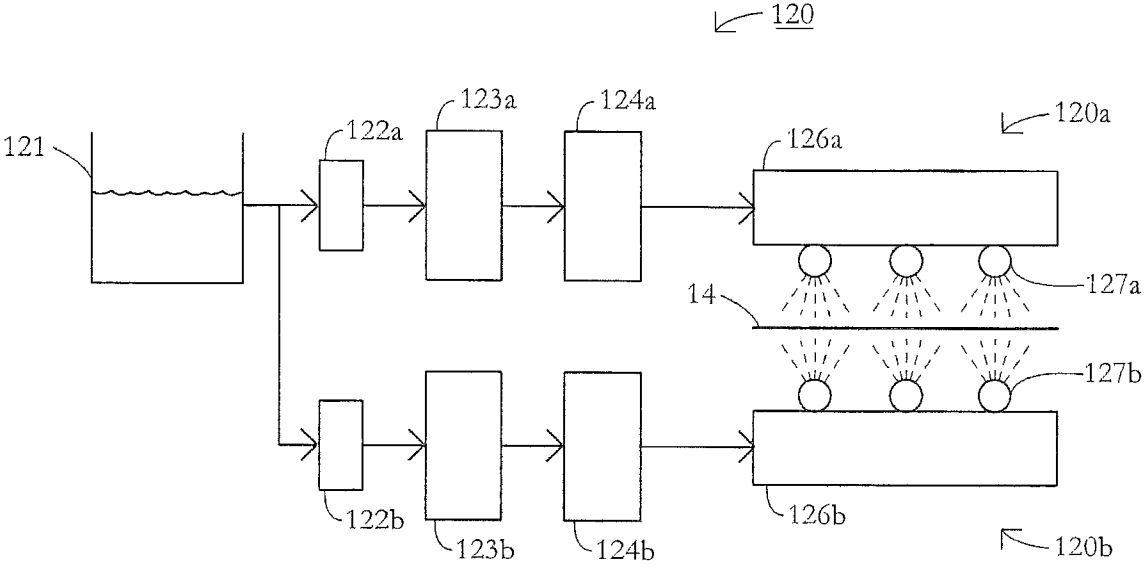
FIG. 3 is a schematic view of the spray dyeing station of the present invention.

The fabric 14 is next drawn through the spray station 120 by downstream rollers 154, where at least one surface, i.e., the technical face or technical back, of the fabric is sprayed with dye. As illustrated schematically in FIG. 1, in one embodiment the spray station 120 comprises upper and lower portions 120*a* and 120*b*, for spraying both technical faces of the flat tubular fabric 14. Referring to FIG. 3, the spray station 120 is shown in greater detail. A vessel 121 holds the desired volume of a dye composition, such as a reactive dye mixture. The terms "reactive" or "reacts," as used herein, refer to the reaction of the dye with the fabric that results in the formation of an attachment to one or more components of the fabric, such as by a covalent bond. Suitable reactive dye compositions are described in U.S. Pat. No. 4,786,721 and in pending U.S. patent application Ser. Nos. 11/338,346, 11/656,769, and 12/329,684, which are incorporated herein by reference. The present invention reduces the amount of water required for dyeing the fabric. Specifically, whereas conventional dyeing processes require about a 6:1 ratio of water to dye, the system and method of the present invention require only about a 1:6 ratio of water to dye.

The dye composition is drawn from the vessel 121 by fluid pumps 122. As shown in FIG. 3, where the spray station comprises upper and lower portions 120*a* and 120*b*, the system 100 comprises two parallel paths and two fluid pumps 122*a*, 122*b* in parallel. To regulate the volume of dye composition sprayed onto the faces of the fabric 14, the dye composition is pumped through flow meters 123*a*, 123*b*, which are selectively set for the particular fabric type and construction, as well as the type and composition of the dye composition. The dye composition next moves through pressure regulators 124*a*, 124*b* where the pressure of the spray also is selectively set, depending upon the width of the fabric and the percentage of wet pickup needed for penetration of the dye. In one exemplary operation, the pressure of the spray is about 40 pounds per square inch. Lastly, the dye composition is delivered to manifolds 126*a*, 126*b*, each manifold 126 being in fluid communication with a plurality of spray nozzle heads 127*a*, 127*b*. In the embodiment shown in FIG. 3, each manifold 126 has three spray nozzle heads 127; however, the actual number of spray nozzle heads is dependent upon factors that include width of the fabric being sprayed.

The spray nozzle heads 127 apply the dye composition to the top and bottom surfaces, i.e., technical faces, of the open fabric 14 with dye. In one exemplary embodiment, the spray nozzles are arranged to deliver the dye composition to cover an angle of 110 degrees or less, as measured from the center of the manifolds 126*a*, 126*b*. As will be appreciated, this coverage is dependent upon the width of the fabric and the distance between the spray nozzles 127 and the face of the fabric 14. More particularly, the spray nozzles are arranged so that the dye is applied up to, but not beyond, the edges of the fabric, such that there is no overspraying of the fabric and no wastage of dye. This permits the dye to migrate around the edges of the fabric and through the fabric. Additionally, the spray nozzles are configured so that the dye composition is sprayed evenly across the width of the fabric. Further, the spray nozzles are sized, and the settings of the flow meters 123 and pressure regulators 124 selected to achieve between about 65 percent and 85 percent saturation of the total fabric, i.e., the percentage of the maximum amount that the fabric can hold.

The fabric positioning station 110 and the spray station 120 described herein are equally effective in applying a bleach composition to the fabric 14. For bleaching applications, the system may be configured so that the bleach composition and optical brighteners are mixed at the spray nozzles 127 via a separate fluid line (not shown). A suitable bleach composition is described in pending U.S. patent application Ser. No. 12/329,680, also incorporated herein by reference. The particular fabric construction and the constituents of the bleach composition will determine the extent to which the remaining portions of the system 100 described herein may be employed to treat the bleached fabric; however, it is contemplated that the system may be used to further treat the bleached fabric, such as applying softeners, stain releases, wicking agents, etc.

In some embodiments of the present invention, the system further comprises one or more heating devices 130 positioned between the spray station 120 and the downstream fixation station 150. The heating devices are set to initiate the chemical reaction of the dye.

The dyed fabric 14 is next drawn over a guide roller 129 and through the fixation station 150 by rollers 154*a*, where the dyed fabric 14 is exposed to atmospheric steam, i.e., steam at atmospheric pressure, before the dye dries on the fabric. As discussed above, the color fixation station 150 exposes the fabric 14 to steam and heat in a manner and amount sufficient to spread the dye throughout the fabric, i.e., from the technical face to the technical back, and affix the dye to the fabric as the fabric is continuously moved through the station 150. As shown in FIG. 1, the color fixation station 150 comprises a steam box 152, and a plurality of rollers 154*a*, 154*b* for transporting the fabric through the steam box 152 in a lengthy path, exposing both technical faces of the fabric to similar conditions. In one embodiment, only the uppermost rollers 154*a* are driven. More particularly, steam entering the steam box maintains the exposure temperature in the steam box 152 at between about 196 degrees Fahrenheit and 210 degrees Fahrenheit, and at a relative humidity of between about 60 percent and 90 percent. In one embodiment, the arrangement and rotational speed of the rollers 164 creates a path through the steam box of about nine yards (27 feet) and a dwell time within the steam box 152 of between about three minutes and four minutes. While FIG. 1 schematically shows five rollers 154*a*, 154*b*, the number of rollers may be increased or decreased depending upon the desired amount of exposure of the fabric 14 to the steam.

Of course, it is contemplated by the present disclosure for rollers 154 to be horizontally arranged, angled with respect to the horizontal or vertical, or combinations thereof. It is also contemplated to adjust the speed of rollers 154 with respect to one another so that the fabric 14 relaxes as it moves through the fixation station 150. Advantageously, the rollers 154 are configured to minimize surface contact with the fabric 14 during the fixation process.

Following fixation of the dye in the fixation station 150, the dyed fabric is advanced through ring guides 153 into at least one rinse station. Again, the ring guides 153 hold the fabric taut as it advances into the first rinse station. As shown in FIG. 1, in one embodiment there are two stations provided, shown as 160 and 170, respectively. The fabric also may be overfed into the first rinse station 160 to reduce residual stresses in the fabric.

Figure 4:
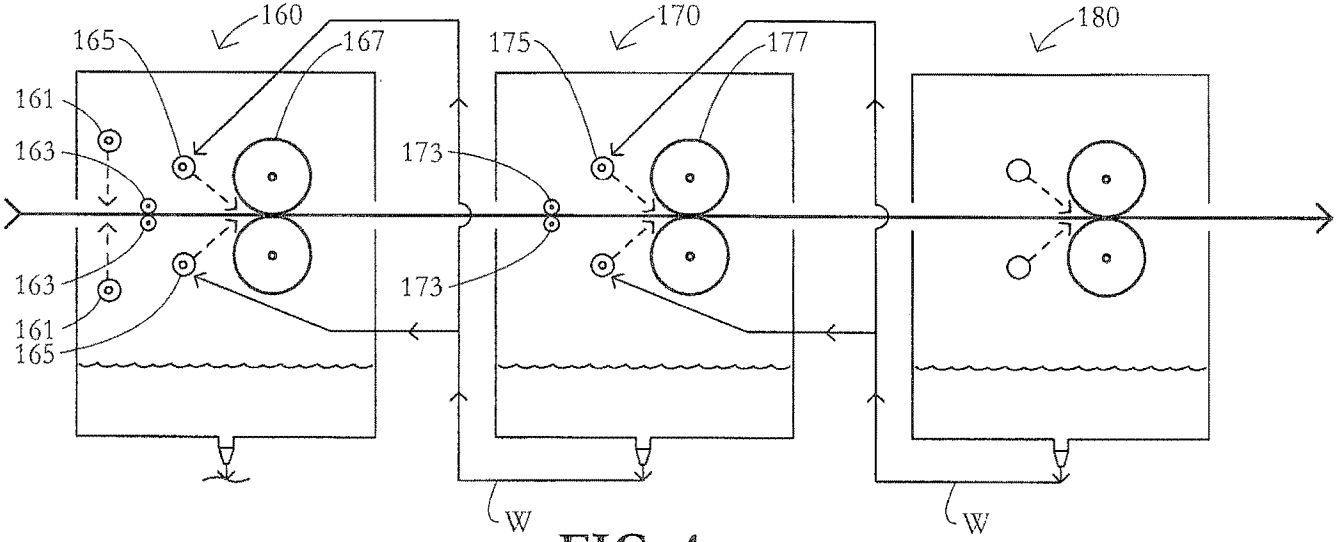
FIG. 4 is a schematic view of the rinsing stations of the present invention.

Turning to FIG. 4, the rinse stations 160 and 170 are shown in greater detail. Upon passing into the first rinse station 160, the fabric 14 is sprayed with pressurized hot water having a temperature of between about 100 degrees Fahrenheit and 180 degrees Fahrenheit, with about 160 degrees Fahrenheit being preferred. The use of pressurized hot water ensures the minimal use of water in the rinse process. Upon entering the first rinse station 160, the fabric is drawn through ring guides 163 by downstream nip rollers 167 before spray nozzles 161 and 163 direct a pressurized spray vertically upward and vertically downward against the fabric. The spray action of these nozzles serves two functions. First, the vertical action of the pressurized spray cleans the dyed fabric, removing any unaffixed hydrolyzed dye, residual chemicals, and insolubles from the fabric 14. Second, the pressurized action of the vertically directed nozzles serves to compact the tubular knitted fabric 14. As the fabric approaches a first set of nip rollers 167, two additional spray nozzles 165 are directed angularly upward and angularly downward toward the entrance to the nip rollers 167 to further clean and to further compact the tubular knitted fabric by the mechanical action of pushing the knitted loops (courses) of the fabric 14 against the nip rollers 167. This effectively reduces the subsequent residual shrinkage in the fabric and apparel formed therefrom.

Each of the nozzles 161 and 165 deliver about 2.6 gallons of fluid per minute at a pressure of about 1,800 pounds per square inch, for a spray volume of about six gallons per linear yard of fabric 14. The cleaning fluid mixture comprises water at a temperature of about 160 degrees Fahrenheit, and a neutralizing agent. One suitable neutralizing agent is acetic acid. If the fabric is being bleached instead of being dyed, a peroxide scavenger is also added to the mixture. Upon passing through the first set of nip rollers 167, about 60 percent of the excess rinse water and chemical mixture is extracted from the fabric 14. In addition to substantially reducing the volume of water required for the cleaning and treatment at the first rinse station 160, the resulting extracted hydrolyzed dye and liquid are not environmentally harmful.

After passing through the nip rollers 167, the fabric is drawn through ring guides 173 by downstream nip rollers 177 where two spray nozzles 175, angled in the same fashion as the angled spray nozzles 165, further compact the fabric 14 as it enters the second set of nip rollers 177. The nozzles also may apply a finish such as a softener and water composition. Spray nozzles 175 also deliver about 2.6 gallons per minute at a pressure of about 1,200 pounds per square inch, for a total volume of about six gallons per linear yard. Upon passing through the nip rollers 177, approximately 60 percent of the excess rinse water and softener finish is extracted.

In some embodiments, one or more of the rinse stations may provide a pH adjustment. Alternatively, the system 100 may comprise a third rinse station 180, shown in FIG. 4, wherein the rinse water has a predetermined pH level so that the rinse water adjusts the pH of the dyed fabric to a pH that is neutral or slightly acidic. Any of the rinse stations may further deliver a fragrance, a stain repellant component, a water repellant component, etc. Additionally, the first set of nip rollers 167 and second set of nip rollers 177 may have differential rotational speeds; i.e., the speed of the first set 167 may be greater than the speed of the second set 177, thus overfeeding to the second set 179 to further facilitate compaction. The pressure applied by the nip rollers 167, 177 sets the moisture level remaining in the fabric 14 to between about 20 percent and 60 percent saturation.

In one embodiment, the system 100 of the present invention is configured to recirculate rinse water from the rinse stations to further reduce the amount of water consumed during the dyeing and finishing of the fabric 14. As will be appreciated by those in the art, the rinse water collected in the rinse station basis of the most downstream rinse station will be the cleanest, as it will contain the least hydrolyzed dye, chemicals, and/or insolubles. Thus, as shown by the arrows, W, collected rinse water from rinse station 180 is recirculated to the spray nozzles 175 in the second rinse station 170. Similarly, the collected rinse water from the second rinse station 170 is recirculated to the spray nozzles 165 in the first rinse station 160. Finally, the rinse water from the first rinse station 160 is drained or pumped for wastewater disposal.

Figure 5:
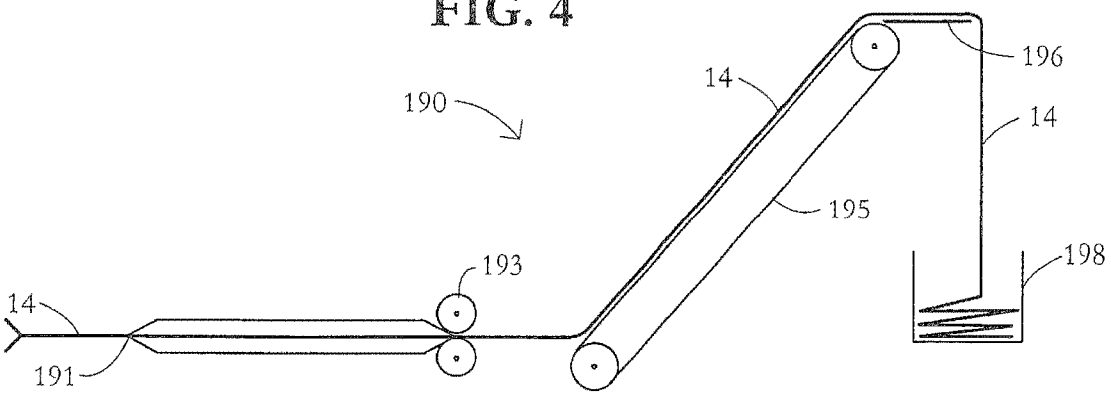
FIG. 5 is a schematic view of the collection unit of the present invention.

Upon exiting the second rinse station 170, or third rinse station 180, if included in the system configuration, the system and process may comprise a collection unit 190 for the finished, wet fabric 14. An exemplary embodiment of a collection unit 190 according to the present disclosure is shown in FIG. 5. The collection unit 190 includes an opening unit 191, an inclined relaxing conveyor 195 a platter 196 and a fabric receptacle 198.

As shown in FIG. 5, as the fabric 14 exits the second rinse station 180, it is opened by the opening unit 191. The fabric is engaged by a final set of edge drives 193, which set the width of the fabric for the subsequent collection and drying. The fabric 14 is then deposited onto the inclined relaxing conveyor 195 in a tensionless state. The fabric 14 exits the conveyor 195 via the platter 195 and is collected in the fabric receptacle 198.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that this invention will include all embodiments falling within the scope of the present disclosure.

What is claimed is:

1. A rinsing system for removing residual materials from a dyed or bleached flat tubular fabric, the rinsing system comprising:

a first rinsing station comprising:

a first pair of rinse spray nozzles, one of the first pair of rinse spray nozzles being configured to spray a rinse liquid downwardly as a jet of finely divided liquid onto a first technical face of the fabric, and the other of the first pair of rinse spray nozzles being configured to spray the rinse liquid upwardly as a jet of finely divided liquid onto a second technical face of the fabric;

a first pair of nip rollers downstream from the first pair of rinse spray nozzles for extracting the rinse liquid from the fabric; and a first rinse liquid collector configured to collect the rinse liquid;

a second rinsing station, upstream of the first rinsing station, the second rinsing station comprising:

a second pair of rinse spray nozzles, wherein one of the second pair of rinse liquid spray nozzles is directed angularly downward as a jet of finely divided liquid onto the first technical face of the fabric, and the other of the second set of rinse spray nozzles is directed angularly upward as a jet of finely divided liquid onto the second technical face of the fabric; and a second pair of nip rollers downstream of the second pair of rinse spray nozzles, the second pair of rinse spray nozzles being angled toward the second pair of nip rollers; and a fluid recirculation circuit in fluid communication with the first rinse liquid collector and the second pair of rinse spray nozzles, wherein the second pair of rinse spray nozzles is configured to spray recirculated rinse liquid collected by the first rinse liquid collector.

2. The rinsing system of claim 1, wherein the first pair of rinse spray nozzles sprays at least water as the rinse liquid, the water having a temperature of from about 100 to about 180 degrees Fahrenheit.

3. The rinsing system of claim 2, wherein the first pair of rinse spray nozzles sprays the rinse liquid at a pressure of about 1,800 pounds per square inch.

4. The rinsing system of claim 2, wherein the rinse liquid further comprises a neutralizing agent.

5. The rinsing system of claim 2, wherein the rinse liquid further comprises a peroxide scavenger.

6. The rinsing system of claim 2, wherein the rinse liquid further comprises at least one of a fragrance, a stain repellant component, and a water repellant component.

7. The rinsing system of claim 1, wherein the rinse liquid has a predetermined pH level, the predetermined pH level being selected so that the rinse liquid adjusts a pH of the fabric so that the pH of the fabric is slightly acidic.

8. The rinsing system of claim 1, wherein one of the first pair of rinse spray nozzles is directed downwardly perpendicular to the fabric, and the other of the pair is directed upwardly perpendicular to the fabric.

9. The rinsing system of claim 1, further comprising a third pair of rinse spray nozzles positioned so that the third pair of rinse spray nozzles is downstream of the first pair of rinse spray nozzles and upstream of the first nip rollers.

10. The rinsing system of claim 9, wherein one of the third pair of rinse spray nozzles is directed angularly downward onto the fabric toward the first nip rollers and the other nozzle of the third pair of rinse spray nozzles is directed angularly upward onto the fabric toward the first nip rollers.

11. The rinsing system of claim 1, wherein the first pair or nip rollers extracts the rinse liquid from the fabric so that the fabric has a moisture level of from about 20 percent to about 60 percent.

12. The rinsing system of claim 1, further comprising a pair of guide rings through which the fabric is drawn by the first pair of nip rollers.

13. The rinsing system of claim 1, further comprising:

a third rinsing station downstream of the first rinsing station, comprising a second rinse liquid collector configured to collect the rinse liquid; and a second fluid recirculation circuit in fluid communication with the second rinse liquid collector and the first pair of rinse spray nozzles, wherein the first pair of rinse spray nozzles is configured to spray recirculated rinse liquid collected by the second rinse liquid collector.

14. The rinsing system of claim 1, wherein the first pair of nip rollers of the first rinsing station and the second pair of nip rollers of the second rinsing station each have a rotation speed, and the rotation speed of the first pair of nip rollers of the first rinsing station differs from the rotation speed of the second pair of nip rollers of the second rinsing station.

15. The rinsing system of claim 14, wherein the first pair of nip rollers of the first rinsing station rotate at a faster speed than the second pair of nip rollers of the second rinsing station.

16. A method for rinsing fabric being run through a fabric dying or bleaching system, the method comprising:

accepting taut, flat tubular fabric into a first rinsing station;

providing water collected at a second rinsing station to the first rinsing station;

spraying the provided water as a jet of finely divided liquid downwardly onto a first technical face of the fabric with a first nozzle;

spraying the provided water as a jet of finely divided liquid upwardly onto a second technical face of the fabric with a second nozzle;

extracting at least some of the water from the sprayed fabric with a first pair of nip rollers;

accepting the fabric into the second rinsing station;

spraying water as a jet of finely divided liquid downwardly onto the first technical face of the fabric with a third nozzle;

spraying water as a jet of finely divided liquid upwardly onto the second technical face of the fabric with a fourth nozzle;

extracting at least some of the water from the sprayed fabric with a second pair of nip rollers;

collecting at least some of the water extracted by the second pair of nip rollers.

17. The method of claim 16, further comprising:

spraying the first technical face of the fabric with a fifth nozzle, the fifth nozzle being downstream of the first nozzle and upstream of the first pair of nip rollers, the fifth nozzle being angled downwardly towards the fabric and toward the first nip rollers; and spraying the second technical face of the fabric with a sixth nozzle, the sixth nozzle being downstream of the second nozzle and upstream of the first pair of nip rollers, the sixth nozzle being angled upwardly toward the fabric and toward the first nip rollers.

18. The method of claim 17, wherein spraying with the fifth nozzle and the sixth nozzle push knitted loops of the fabric against the first pair of nip rollers to reduce subsequent residual shrinkage in the fabric and apparel formed therefrom.

19. The method of claim 16, wherein collecting at least some of the water extracted by the second pair of nip rollers further comprises:

adding a neutralizing agent to the collected water before providing the water to the first rinsing station;

adjusting, by the neutralizing agent, the pH of the collected water to a predetermined pH level selected so that the collected water adjusts a pH of the fabric so that the pH of the fabric is neutral or slightly acidic after being sprayed by the first rinsing station.

20. The method of claim 16, further comprising:

accepting the fabric into a third rinsing station;

spraying water downwardly onto the first technical face of the fabric with a fifth nozzle;

spraying water upwardly onto the second technical face of the fabric with a sixth nozzle;

extracting at least some of the water from the sprayed fabric with a third pair of nip rollers;

collecting at least some of the water extracted by the third pair of nip rollers;

providing water collected at the third rinsing station to the second rinsing station, wherein the water sprayed by the first nozzle and the second nozzle is the water collected at the third rinsing station.

* * * * *